United States Patent [19]

Greenwald

[11] 4,092,037

[45] May 30, 1978

[54] DOOR-LOCKING DEVICE

[76] Inventor: Albert T. Greenwald, 875 Ray Ave., Union, N.J. 07083

[21] Appl. No.: 802,362

[22] Filed: Jun. 2, 1977

[51] Int. Cl.[2] ..... E05C 3/04

[52] U.S. Cl. ..... 292/202

[58] Field of Search ..... 292/202–211, 292/DIG. 15, DIG. 46, 238

[56] References Cited

U.S. PATENT DOCUMENTS

| | | | |
|---|---|---|---|
| 349,688 | 9/1886 | Buckingham | 292/339 |
| 1,791,387 | 2/1931 | Stargardt | 292/202 X |
| 1,928,655 | 10/1933 | Sarrasin | 292/202 |
| 2,041,430 | 5/1936 | Plym | 292/202 X |
| 3,993,336 | 11/1976 | Frost | 292/288 |

*Primary Examiner*—Richard E. Moore

*Attorney, Agent, or Firm*—Lerner, David, Littenberg & Samuel

[57] ABSTRACT

A door-locking device is provided which includes a first member which is adapted to be fixedly attached to a floor adjacent to the door to be locked and is attached to the floor at a point where the first member is out of the path of movement of the door as it moves between its open and closed positions. A second member is pivotally connected to the first member and is movable between a locking position and a retracted position relative to the door to be locked. When in the locking position, the second member is pivoted into the path of movement of the door to prevent the door from being moved from a closed position to an open position. When it is desired to unlock the door, the second member is pivoted upwardly relative to the first member to its retracted position where the second member is out of the path of movement of the door to allow its movement from the closed to the open position.

6 Claims, 5 Drawing Figures

DOOR-LOCKING DEVICE

FIELD OF THE INVENTION

The present invention relates generally to locking devices, and specifically to an improved and simplified door-locking device which includes only two members to securely prevent a door from being opened and avoids any problems with respect to locks being picked or broken to gain entry.

BACKGROUND OF THE INVENTION

In recent years, there has been a growing concern with respect to the increase in the number of burglaries of houses, apartments, offices, and the like. Many complex and expensive locking devices have been developed and installed in an attempt to prevent such burglaries or any undesired entry. Such locking devices include the so-called unpickable locks, chain locks, bars for doors, and the like. However, presently-employed locking devices have various drawbacks. For example, many of such locks can actually be picked by the experienced burglar, or such locks are expensive or bulky. In addition, as will be understood, the use of bars for doors is not only bulky but is also unsightly. Therefore, it has long been desired to develop a door-locking device which is highly reliable and secure but is also inexpensive and unobtrusive. There have been many attempts to provide such a locking device. For example, as shown in U.S. Pat. No. 1,061,269, there is a door-locking device which is attachable to the floor adjacent the door to be locked, wherein a portion of the device is movable into and out of the moving path of the door to be locked. In this patent, a removable block is placed between the door and the pivoting device to prevent the door from being opened. However, the removable block is not secured to the pivoting portion so that it is possible for the removable block to be knocked off of the pivoting support so that an intruder can gain entry. Accordingly, the type of locking device disclosed in this patent is not completely secure and reliable.

Broadly, it is an object of the present invention to provide a door-locking device which overcomes the aforesaid problems. Specifically, it is within the contemplation of the present invention to provide an improved door-locking device which is simple and inexpensive to construct, but which is highly reliable and secure in preventing an intruder from gaining entry through the locked door.

It is a further object of the present invention to provide an improved door-locking device which is simple to install and operate and eliminates the prior art problems of door locks which may be picked or broken to gain entry.

SUMMARY OF THE INVENTION

Briefly, in accordance with the principles of the present invention, an improved door-locking device is provided which includes a first member which is adapted to be fixedly attached to a floor adjacent the door to be locked and is attached at a point on the floor which is out of the path of movement of the door. A second member is pivotally connected to the first member and is movable between a locking position and a retracted position. When in the locking position, the second member is in the path of movement of the door and prevents its movement from the closed position to the open position. When it is desired to open the door, the second member is pivoted upwardly to its retracted position where it is out of the path of movement of the door so that it may be moved from its closed position to its open position.

Advantageously, the improved locking device of the present invention is simple in construction and inexpensive to manufacture. In addition, it is simple to install in any apartment, home, or office and is completely reliable and secure. In fact, the improved door-locking device of the present invention is so secure that it may be referred to as foolproof, since there is no way to open a door once the movable member of the locking device is pivoted into its locking position, except for literally breaking a door down.

BRIEF DESCRIPTION OF THE DRAWINGS

Further objects, features, and advantages of the present invention will become apparent upon the consideration of the following detailed description of a presently-preferred embodiment when taken in conjunction with the accompanying drawing, wherein.

DETAILED DISCUSSION OF PREFERRED EMBODIMENT OF THE INVENTION

Figure 3:
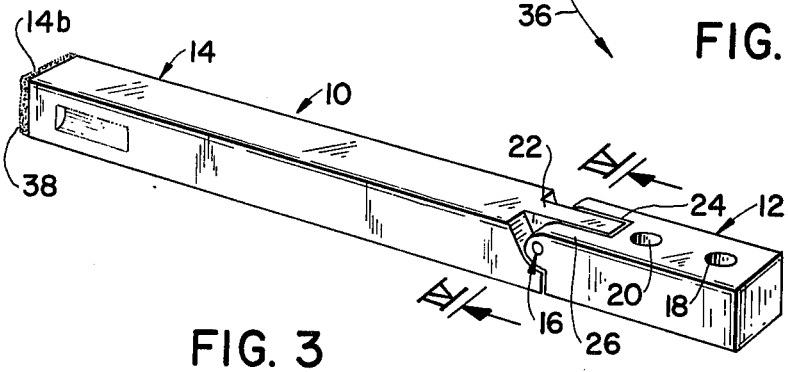
FIG. 3 is a detailed perspective view of a door-locking device embodying the principles of the present invention.

Referring now to FIG. 3, there is shown the improved door-locking device of the present invention, generally designated by the reference numeral 10, which includes a first member 12 for fixedly attaching the device 10 to a floor adjacent the door to be locked and a second member 14 pivotally connected by a hinge arrangement 16 to the first member 12, with the second member 14 being movable between a locking position and a retracted position.

Figure 1:
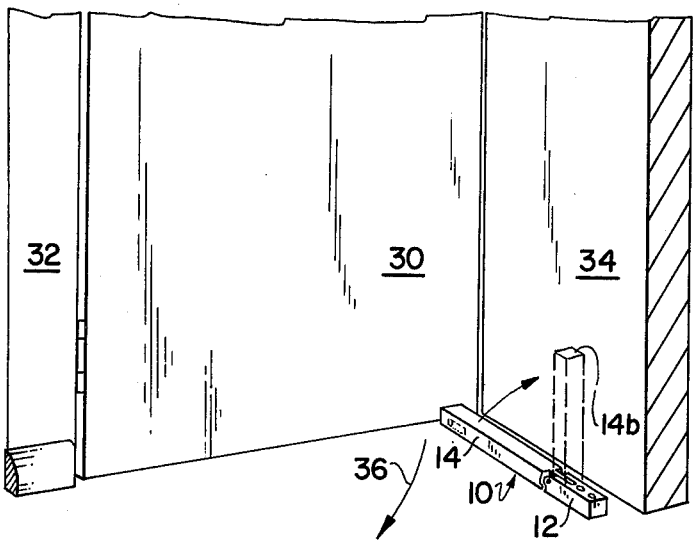
FIG. 1 is a perspective view of a door illustrating the use of a door-locking device in accordance with the present invention.
Figure 2:
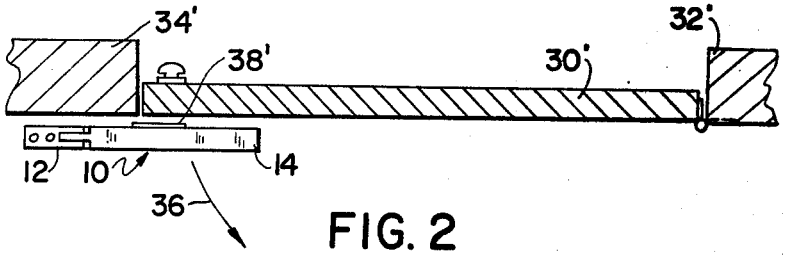
FIG. 2 is a top plan view of the locking device of the present invention being installed in an alternative location relative to the door.

As shown most clearly in FIG. 3, the fixed member 12 is provided with screw holes 18, 20 for receiving screws or other suitable means for attaching the member 12 to a floor, as shown in FIGS. 1 and 2. The member 14 is essentially an elongated bar and is of a greater length than fixed member 12 so that when movable member 14 is pivoted upwardly, the locking device 10 will be out of the path of movement of the door. Of course, members 12, 14 can be formed of any suitable material, such as steel, aluminum, or molded plastic.

Figure 4:
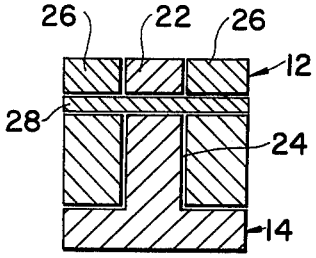
FIG. 4 is a cross-sectional view, taken on the line 4—4 of FIG. 3, to illustrate the details of the pivot connection between the first and second members of the door-locking device.
Figure 5:
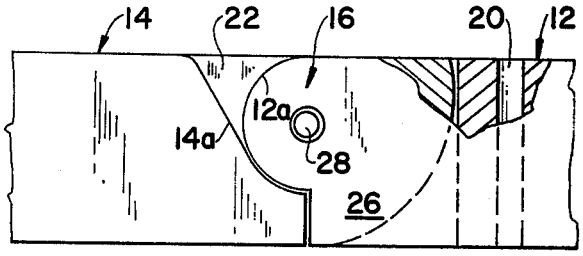
FIG. 5 is a side elevational view, partially broken away, illustrating the details of the pivot connection.

Referring now to FIGS. 4 and 5, the hinge arrangement 16 is shown in detail. The hinge arrangement 16 is of the tongue and groove type, as movable member 14 includes a tongue 22 which is received within a groove 24 formed in fixed member 12, with the groove 24 being surrounded by connecting ears 26. A suitable pin or rivet 28 is provided and extends through ears 26 and tongue 22 to hold members 12, 14 in pivotal engagement with respect to each other.

Referring specifically to FIG. 5, the hinge arrangement 16 is shown in further detail. As will be noted, the hinged end of movable member 14 is provided with curvilinear surfaces 14*a* which are adapted to pivot about curvilinear surfaces 12*a* to provide a smooth relative movement between the two members.

Referring now to FIG. 1, there is shown the door-locking device 10 of the present invention installed adjacent a door 30 to be locked which is situated between fixed walls 32, 34. As shown in FIG. 1, the locking device 10 must be situated perpendicular to the door 30 to prevent its opening, as fixed wall 34 prevents locking device 10 from being installed parallel to the door 30. As shown in FIG. 1, door 30 moves through its closed position and open position through a path of movement indicated by arrow 36. As will be noted, fixed member 12 is fixedly attached to the floor adjacent the wall 34 at a point out of the path of movement of door 30, but spaced from door 30, approximately the distance equal to the length of movable member 14. In this manner, when movable member 14 is pivoted upwardly to its retracted position, it is out of the path of movement of door 30 so that the door may be moved between its open and closed position, also without interference from fixed member 12. Of course, as will be seen in FIG. 1, locking device 10 is placed close to fixed wall 34 so that when locking device 10 is in its inoperative position, it will not interfere with people walking through the entranceway 30.

To maintain door 30 in its locked position, movable member 14 is pivoted downwardly. As fixed member 12 is spaced from door 30, approximately the length of movable member 14, when movable member 14 is pivoted downwardly into the locking position, the forward end 14*b* of movable member 14 will contact door 30 or be substantially close to it. In this manner, if any intruder pushes against the door 30 in an attempt to open it, it will engage the forward end 14*b* of movable member 14 and will securely and reliably prevent the door 30 from being opened. If desired, the forward end 14*b* of movable 14 may be provided with a suitable cushioning means 36 to prevent damage to door 30 if it is forced against door-locking device 10.

Referring now specifically to FIG. 2, there is shown an alternative arrangement for installing door-locking device 10, in such cases where there is no interference from a fixed wall and allows the locking device 10 to be installed parallel to the door 30' to be locked. In this case, door 30' is situated between fixed walls 32' and 34'. However, fixed wall 34' does not interfere with door-locking device 10 being installed parallel to door 30'. As will be understood, fixed member 12 is installed adjacent wall 30' and out of the path of movement of door 30' but at a distance from door 30' such that when movable member 14 is pivoted into its locking position, it will lie in the path of movement of the door 30' to prevent movement of the door from its locked position to its open position. In such an arrangement, a suitable cushioning pad 36' may be provided on the sidewall of movable member 14 to prevent door 30' from being damaged if door 30' is forced against locking device 10. Of course, when it is desired to unlock door 30', movable member 14 is pivoted upwardly to its retracted position and out of the path of movement 36 of door 30'.

It will be appreciated that there has been provided in accordance with the present invention a simply-constructed and inexpensive door-locking device which is easy to install and which securely and reliably prevents a door from being opened when it is in the locking position. In addition, when the device is its retracted or inoperative position, it is unobtrusive and out of the way. Accordingly, even though it is permanently mounted on the floor, it is mounted adjacent a rigid wall, so that it will not interfere with a person passing through the entranceway and is therefore completely safe. Of course, it will be understood that the door-locking device of the present invention avoids the need for complex and expensive locks which may be picked or broken by the undesired intruder.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A door-locking device, comprising:

a first member for fixedly attaching said door-locking device to a floor adjacent the door to be locked at a point out of the path of movement of said door; and a second member pivotally connected to said first member and being movable between a lower locking position and an upper retracted position, the lower locking position of said second member being longitudinally aligned with said first member and in the path of movement of said door to prevent said door from being moved from a closed position to an open position, and said second member being pivotable upwardly to said retracted position out of the path of movement of said door to allow movement of said door from said closed position to said open position.

2. A door-locking device in accordance with claim 1, wherein said first member includes means for fixedly attaching said door-locking device to said floor.

3. A door-locking device in accordance with claim 1, wherein said second member is of a greater length than said first member so that when said second member is pivoted to said retracted position, said door-locking device is out of the path of movement of said door.

4 A door-locking device in accordance with claim 1, including means for pivotally connecting said first and second members, said connecting means including a hinge arrangement, said hinge arrangement being of the tongue and groove type.

5. A door-locking device in accordance with claim 1, wherein said second member includes an end face for engaging the door to be locked.

6. A door-locking device in accordance with claim 1, wherein said second member includes a sidewall for engaging the door to be locked.

* * * * *